US006610619B2

(12) United States Patent
Friedbauer et al.

(10) Patent No.: US 6,610,619 B2
(45) Date of Patent: Aug. 26, 2003

(54) PATTERNED FELTS FOR BULK AND VISUAL AESTHETIC DEVELOPMENT OF A TISSUE BASESHEET

(75) Inventors: Charles E. Friedbauer, Marysville, WA (US); Michael A. Hermans, Neenah, WI (US); John C. Bolt, Appleton, WI (US); Michael C. Johnson, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 110 days.

(21) Appl. No.: 09/750,407

(22) Filed: Dec. 28, 2000

(65) Prior Publication Data

US 2001/0032712 A1 Oct. 25, 2001

Related U.S. Application Data

(60) Provisional application No. 60/173,628, filed on Dec. 29, 1999.

(51) Int. Cl.[7] ..... D03D 15/02; D21H 11/00

(52) U.S. Cl. ..... 442/320; 139/383 A; 139/425 A; 139/42; 162/109; 162/358.2; 162/358.4; 162/900; 162/901; 162/902

(58) Field of Search ..... 139/383 A, 425 A, 139/42; 162/109–117, 358.2, 358.4, 900–904

(56) References Cited

U.S. PATENT DOCUMENTS

| | | | | |
|---|---|---|---|---|
| 1,949,677 A | * | 3/1934 | Crawford | 150/152 |
| 2,038,712 A | | 4/1936 | Brodin | |
| 3,705,079 A | | 12/1972 | Lee et al. | |
| 4,154,883 A | | 5/1979 | Elias | |
| 4,157,276 A | * | 6/1979 | Wandel et al. | 162/348 |
| 4,212,703 A | | 7/1980 | D'Amico et al. | |
| 4,230,746 A | * | 10/1980 | Nahta | 427/373 |
| 4,382,987 A | | 5/1983 | Smart | |
| 4,440,597 A | | 4/1984 | Wells et al. | |
| 4,514,345 A | | 4/1985 | Johnson et al. | |
| 4,533,437 A | | 8/1985 | Curran et al. | |
| 4,552,620 A | | 11/1985 | Adams | |
| 4,556,451 A | | 12/1985 | Ely | |
| 4,889,512 A | * | 12/1989 | Burnett et al. | 446/72 |
| 4,942,077 A | | 7/1990 | Wendt et al. | |
| 5,039,693 A | * | 8/1991 | Okada et al. | 112/440 |
| 5,071,697 A | | 12/1991 | Gulya et al. | |
| 5,126,015 A | | 6/1992 | Pounder | |
| 5,161,207 A | | 11/1992 | Pikulski | |
| 5,230,776 A | | 7/1993 | Andersson et al. | |

(List continued on next page.)

FOREIGN PATENT DOCUMENTS

| | | |
|---|---|---|
| CA | 809923 | 4/1969 |
| CA | 919467 | 1/1973 |
| EP | 0 677 612 A2 | 4/1995 |
| GB | 1059983 | 2/1967 |
| WO | WO 98/59110 | 12/1998 |

OTHER PUBLICATIONS

U.S. Ser. No. 09/748587 filed Dec. 22, 2000 by Burazin et al.

*Primary Examiner*—Glenn Caldarola
*Assistant Examiner*—Alexis A Wachtel
(74) *Attorney, Agent, or Firm*—Steven P. Shurtz; Brinks Hofer Gilson & Lione

(57) ABSTRACT

A method of imparting bulk and/or visual aesthetics to a tissue basesheet involves pressing the basesheet with a felt having a raised pattern on it so that the pattern becomes inherent in the sheet. A pattern is stitched into a carrier layer which is joined to a substrate to form the felt. As the basesheet is pressed into the felt, the raised pattern displaces fibers in the sheet, effectively inducing the pattern in the basesheet. The novel felt with a raised patterned layer is also disclosed.

8 Claims, 3 Drawing Sheets

U.S. PATENT DOCUMENTS 5,314,584 A 5/1994 Grinnell et al.
5,328,565 A 7/1994 Rasch et al.
5,328,757 A * 7/1994 Kenney et al. ..... 428/247
5,334,289 A 8/1994 Trokhan et al.
5,372,876 A 12/1994 Johnson et al.
5,399,412 A 3/1995 Sudall et al.
5,401,557 A 3/1995 Inomata et al.
5,429,686 A 7/1995 Chiu et al.
5,437,908 A 8/1995 Demura et al.
5,510,002 A 4/1996 Hermans et al.
5,527,429 A 6/1996 Dambreville et al.
5,565,132 A 10/1996 Salyer
5,591,309 A 1/1997 Rugowski et al.
5,593,545 A 1/1997 Rugowski et al.
5,607,551 A 3/1997 Farrington, Jr. et al.
5,609,725 A 3/1997 Van Phan
5,637,106 A 6/1997 Mitchell, deceased et al.
5,667,636 A 9/1997 Engel et al.
5,672,248 A * 9/1997 Wendt et al. ..... 162/109
5,693,187 A 12/1997 Ampulski et al.
5,746,887 A 5/1998 Wendt et al.
5,772,845 A 6/1998 Farrington, Jr. et al.
5,804,036 A 9/1998 Phan et al.
5,814,190 A 9/1998 Van Phan
5,820,730 A 10/1998 Phan et al.
5,840,403 A 11/1998 Trokhan et al.
5,874,156 A 2/1999 Schulz
5,885,418 A 3/1999 Anderson et al.
5,888,347 A 3/1999 Engel et al.
6,140,260 A 10/2000 Johnson et al.

* cited by examiner

PATTERNED FELTS FOR BULK AND VISUAL AESTHETIC DEVELOPMENT OF A TISSUE BASESHEET

REFERENCES TO EARLIER FILED APPLICATION

The present application claims the benefit of the filing date under 35 U.S.C. §119(e) of Provisional U.S. Patent Application Ser. No. 60/173,628, filed Dec. 29, 1999, which is hereby incorporated by reference.

FIELD OF THE INVENTION

The present invention relates to papermaking felts and a method for forming high bulk and decorative paper. More particularly, the invention is directed toward patterned papermaking felts for molding or embossing a web during papermaking, and the method of their use.

BACKGROUND OF THE INVENTION

In the manufacture of paper products, particularly tissue sheets, it is generally desirable to provide a final product with as much bulk as possible without compromising other product attributes. Many papermaking machines utilize a process known as "wet-pressing." Fundamentally, in "wet-pressing," a large amount of water is removed from the newly-formed web of paper by mechanically pressing water out of the web, while the web is supported on a papermaking felt, in a pressure nip. The pressure nip is formed between the pressure roll and a Yankee dryer surface as the web is transferred from a papermaking felt to the Yankee dryer. The web may then be creped to soften it and provide stretch to the resulting tissue sheet. A disadvantage of the pressing step is that the pressing step may densify the web, thereby decreasing the bulk and absorbency of the tissue sheet. The subsequent creping step may only partially restore the desired sheet properties. This wet-pressing step, while an effective dewatering means, may compress the web and causes a marked reduction in web thickness and hence bulk.

Papermaking felts may be used to remove the water expelled from the web during the wet-pressing operation. One improvement to conventional felts is the application of a pattern to the felt. The pattern is imprinted into the tissue sheet, thereby producing a corresponding high density pattern in the paper. Generally, in the past, the corresponding high density pattern occurs in the X-Y direction, i.e., within the plane of the paper, in almost all cases, the tensile strength of the paper increases with its density.

One manner in which to apply a pattern layer to a papermaking felt is described in U.S. Pat. No. 5,693,187 issued to Ampulski et al. The pattern layer is created by applying a liquid precursor, typically a curable resin, to the felt. Prior to curing, this liquid precursor permeates the felt. The desired portion of the resin is cured, typically through a patterned mask, to form a solid pattern layer. Any excess liquid resin is removed. Such permeation of the liquid precursor into the felt joins the patterned layer to the felt upon curing.

However, this approach, without more, does not control where the liquid precursor, and hence ultimately after curing, the patterned layer permeates the felt. If too much of the liquid which forms the patterned layer permeates the felt and later cures, the felt becomes impermeable. An impermeable felt is undesirable because it does not allow for water removal from the wet web which is in contact with the felt.

Other patterned papermaking felts are generally made with various hardnesses of yarns woven into the felt material as generally disclosed in U.S. Pat. No. 4,533,437 to Curran et. al. The hard yarns in the felt, when pressed against the web during drying, provide for varying densities in the resulting paper produced. The approach disclosed in Curran et. al. is limited by the indirect contact of the yarns with the sheet and the patterns that can be woven using the yarns. Hence, the felts generally disclosed in Curran et al. have only limited ability to influence sheet bulk and are unable to impart aesthetically pleasing patterns to the sheet.

SUMMARY OF THE INVENTION

The present invention provides new and non-obvious patterned felts for embossing a pattern onto a tissue sheet and methods for imparting bulk and/or visual aesthetics to a tissue sheet. Individual tissue sheets are the building blocks of tissue products. Tissue products include, but are not limited to, facial tissue, bath tissue, and paper towels or the like. A first aspect of the invention is directed to the combination of a felt substrate for pressing a pattern onto a tissue sheet joined to a raised patterned layer. The felt substrate is joined to the raised patterened layer by an attachment mechanism.

In a second aspect of the invention, there may also be embodied a method for making a tissue sheet having increased bulk and visual aesthetics using a raised pattern felt including the steps of pressing the web with a patterned felt so that the pattern becomes inherent in the sheet. In order to accomplish this, the felt is produced, with a design, such as a butterfly, embroidered or otherwise stitched into the raised pattern layer. A bonding coating, such as a foam, may be applied over the raised pattern layer, the pattern being evident in the bonding coating. In one embodiment, "patterned" may mean having a plurality of projections from the web-contacting surface of the carrier which may be arranged in a manner so as to form a design or pattern. As the web is pressed into the felt substrate joined with the patterned foam layer, the pattern displaces fibers in the sheet, effectively inducing the pattern in the web. The degree of bulk or visual aesthetics imparted to the web is dependent on web weight, sheet consistency, bonding coating layer, and nip pressure. Increasing nip pressure and decreasing sheet consistency may effect bulk or visual aesthetics. Further, the degree of bulk or visual aesthetics may also be influenced by larger patterns extending into the z direction, the direction perpendicular to the plane of the felt.

One advantage of a preferred embodiment of the invention is that the patterned felts can impart significantly increased bulk, increased flexibility, and a high absorbent capacity to the resulting tissue product. These improved properties are largely due to the height, orientation, and arrangement of the resulting protrusions in the sheet due to the felt having a patterned layer thereon. All of these properties are desirable for tissue products. The tissue sheets made in accordance with this invention can be used for one-ply or multiple-ply tissue products.

One advantage of an embodiment of the present invention is the addition of bulk and visual aesthetics to a tissue product. A further advantage of an embodiment of the present invention is that the resulting tissue product has an increase in bulk without a reduction in tensile strength of the tissue product.

A further advantage of one embodiment of the invention is to provide a method for adding bulk and visual aesthetics to a tissue product through a patterned layer joined to the felt without having to change any other machine clothing, equipment, or critical process values.

The invention will be better understood in light of the attached drawings and detailed description of the invention.

DETAILED DESCRIPTION OF THE INVENTION

Figure 1:
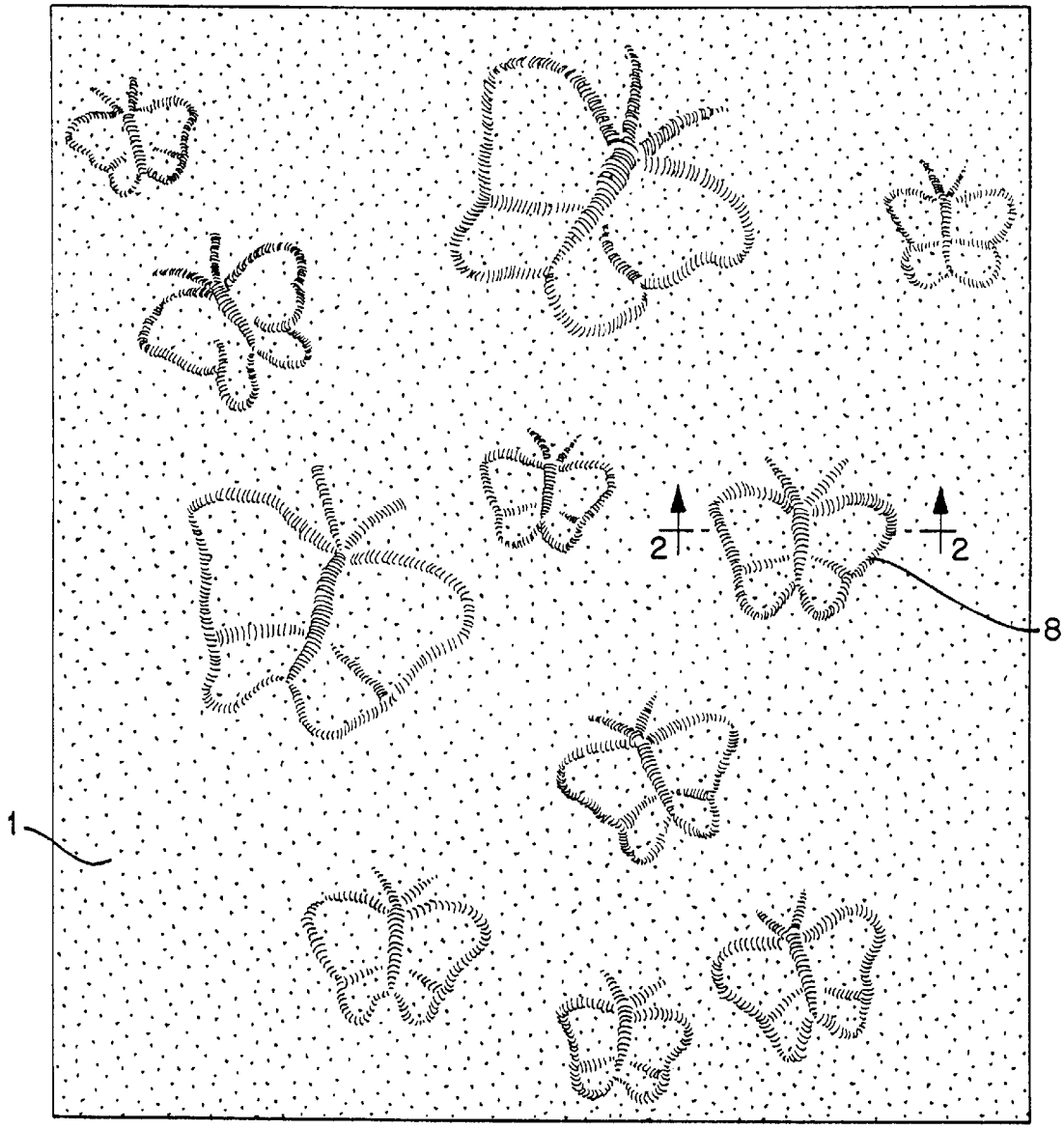
FIG. 1 is a planar view of the patterned felt of the present invention.
Figure 2:
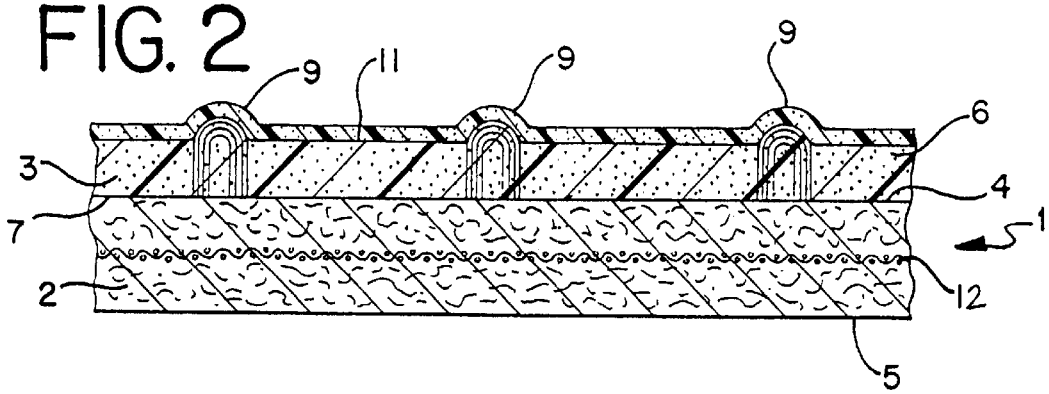
FIG. 2 is a cross section view along line 2—2 of FIG. 1 of the patterned felt of the present invention.

In accordance with the invention, as shown in FIGS. 1 and 2, the felt 1 comprises a substrate layer 2 having a flat carrier layer 3 adhered or joined thereto. A pattern or design 8 is stitched into the carrier layer 3. The substrate layer has a first surface 4 and a second surface 5 opposite the first surface 4. The patterned carrier has a first face 6 which contacts the tissue web and a second face 7 which contacts the first surface 4 of the substrate layer 2. The carrier layer is preferably a non-woven material, such as a spunbond material, and has a raised pattern 8 stitched thereon. By "raised" it is meant having a plurality of projections 9 which are stitched into the web-contacting surface of the carrier. The stitched projections may be arranged so as to form a design or pattern. In one embodiment, the felt 1 may additionally comprise a load-bearing woven base fabric 12. The load-bearing base fabric integrates the substrate 2 while providing sufficient strength to maintain the integrity of the patterned felt 1 as it travels through the Yankee dryer 16 section (shown in FIG. 5) of the paper machine. Further, the substrate is sufficiently porous to enable water to flow through the patterned felt 1 from the web carried by it.

In the embodiment of FIG. 2, a bonding coating layer 11 is coated over the first face 6 of the patterned carrier layer. The bonding coating layer 11 acts so as to stabilize the structure. In an embodiment, the bonding control layer may be a porous polymer material. A preferred polymeric material is an acrylic nitril latex material made by a foaming process, applied at 0.25 pounds per square foot.

The substrate 2 is generally a conventional felt or any other material to which a patterned layer may be adhered or joined. By conventional "felt" it is generally meant a firm woven cloth, and often made with synthetic and/or natural fibers, which is heavily napped and shrunk. Generally, the base fabric 12 is a woven nylon wire similar to a paper machine forming wire that lends integrity and/or strength to the felt. A Flex 1 base fabric from Voith Fabrics of Appleton, Wis., is suitable for the substrate 2.

The carrier 3 of the present invention may be made of a lightweight spunbond material. In a preferred embodiment, the carrier 3 may be made of nylon, such as a 50 gsm Cerex PBN II spunbond nylon. The carrier may be a flow control layer as described in U.S. Pat. No. 5,372,876 to Johnson, hereby incorporated by reference. In fact, a preferred felt 1 may be a felt as described in the Johnson patent, with the pattern 8 formed in an outer layer that will be in contact with the tissue web. The pattern 8 is preferably stitched into the carrier. In an alternative embodiment, the pattern 8 in the carrier 3 is formed by embossing. The raised pattern carrier 3 may be joined to the felt via an attachment mechanism, in a preferred embodiment, needling. In yet another embodiment, the attachment mechanism may be an adhesive. Preferably, the raised pattern layer is attached throughout the length and width of the fabric.

It should be mentioned that the wet pressing paper machine utilizing the patterned felt is substantially the same as a conventional overall wet pressing papermaking machine except for the special characteristics of the dewatering and imprinting patterned felt described in detail above.

Figure 5:
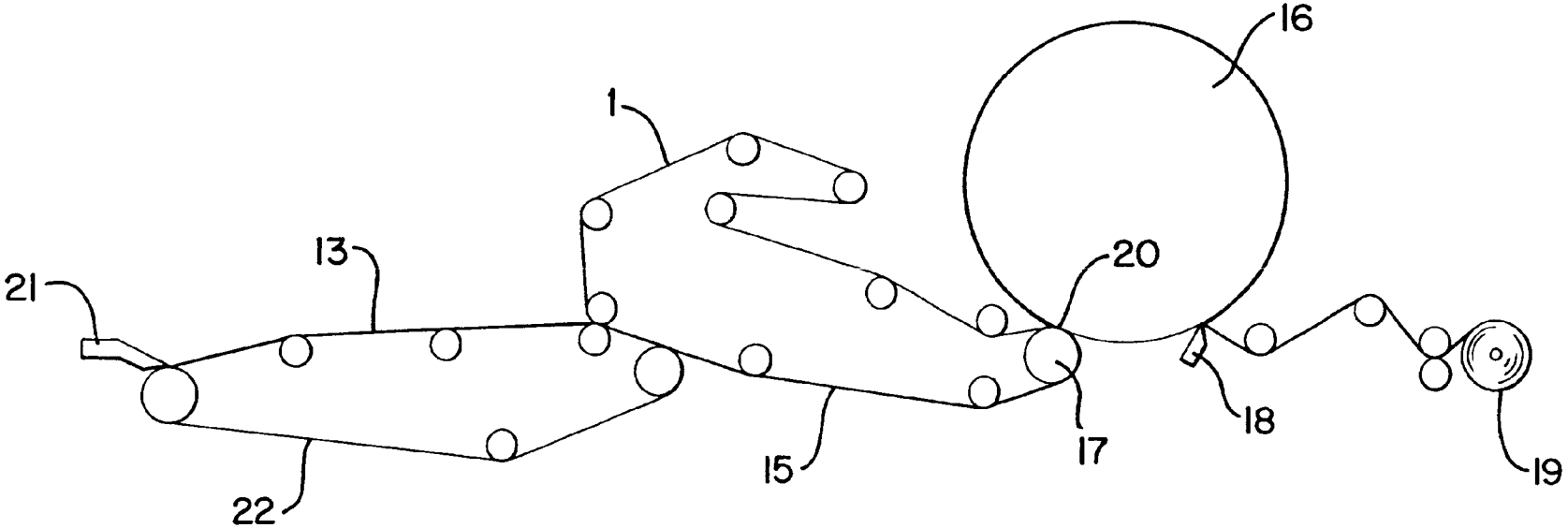
FIG. 5 is a schematic diagram of a typical tissue making apparatus, which is useful for making the tissue products of this invention.

A tissue sheet of the invention having increased bulk and visual aesthetics is formed by the following novel method. Briefly, as shown in FIG. 5, a web 13 of wet papermaking fibers, also known as a furnish, is deposited onto a forming fabric 22 and then transferred to a felt 1 of the present invention having a patterned carrier layer 3 thereon. The forming fabric 22 is an initial fabric or wire mesh upon which the furnish is first laid so as to begin the dewatering process. The web 13 is pressed against the patterned felt 1 of the present invention. At this point, the web 13 is deflected wherein it is macroscopically rearranged to substantially conform the web 13 to the contour of the patterned felt 1. Preferably, the web 13 and patterned felt 1 are passed through a nip 20 formed by a pressure roll 17 and a Yankee drying cylinder 16 so as to deposit the web 13 on the surface of the drying cylinder and further impress the pattern into the web 13, also referred to as a tissue basesheet. As the dewatering and imprinting patterned felt 1 of this invention and the paper web 13 travel through the nip 20, the raised pattern in the felt 1 increases the density of those portions of the dewatered sheet 15 between the raised pattern of the felt 1 and the dryer surface to a greater degree than those portions of the dewatered sheet 15 that are being pressed against the surface of the dryer 16 by the valleys located between adjacent raised pattern material in the carrier 3. After the dewatered sheet 15 is dried on the Yankee dryer 16, it is creped off the drying cylinder by means of a doctor blade 18, thereby leaving a pattern on the sheet 15. In one embodiment, the density of the sheet, due to the patterns, is generally not uniform. The sheet 15 is finally dried to a consistency of about 94 percent or greater on the Yankee dryer 16.

The final sheet 15 has a tissue sheet weight in the range of 7 to 100 gsm with a preferred basesheet weight of approximately 20 gsm.

The following Example is provided as exemplary only and further embodiments commensurate with the spirit of the invention are envisioned.

TESTING AND EXAMPLES

Six felts A–F of the present invention along with a control felt were tested in the production of a tissue sheet with increased visual aesthetics and/or bulk. Six standard TAPPI handsheets were made (numbered 0–5 in the following tables and graphs), one from each experimental felt. A standard TAPPI handsheet was also made from a control felt. The control felt had no visible raised patterns on it like the inventive felts. The following tables delineate the features of each of the sample felts of the present invention along with their particular characteristics.

SAMPLE FELTS

| Sample Number | Weight (OSF) | Air Permeability (CFM) | Caliper (Mils) | Feature |
|---|---|---|---|---|
| 0 | 4.23 | 46 | 116 | A |
| 1 | 4.23 | 47 | 115 | B |
| 2 | 4.18 | 44 | 114 | C |
| 3 | 4.22 | 43 | 113 | D |
| 4 | 4.27 | 35 | 114 | E |
| 5 | 4.27 | 35 | 112 | F |

TABLE OF FEATURES

| Feature | Characteristic |
|---|---|
| A | Butterfly pattern |
| B | 25% reduced butterfly pattern |
| C | Butterfly pattern with foam top- thin foam formulation |
| D | 25% reduced butterfly pattern with foam top - thin formulation |
| E | Butterfly pattern with foam top - thick formulation |
| F | 25% reduced butterfly pattern with foam top - thick foam formulation |

All felts samples A–F have a "butterfly" pattern stitched into the carrier. A butterfly pattern which has a 25% higher yarn density than used in felt sample A is termed "25% reduced." A "foam top" refers to an acrylic nitril latex foam coating layer attached to the carrier layer. A "thin foam formulation" refers to a generally lower viscosity foam material coating partially saturating the surface of the carrier layer. A "thick foam formulation" refers to a generally higher viscosity foam formulation that penetrated less than the thinner foam.

A tissue sheet was produced using the standard TAPPI basesheet method for 48 gsm tissue sheets. The Technical Association of the Pulp and Paper Industry (TAPPI) is an industry group that supports the pulp and paper industry. As one of its functions, it develops and sets test standards. In this instance, TAPPI specifies a standard method for making handsheets that persons skilled in the paper industry would recognize. The furnish used in the formation of the standard TAPPI tissue sheets for both the inventive and control felts was approximately 50 percent LL-19 and 50 percent eucalyptus. 50% LL-19 describes a mixed furnish containing 50% of a Kimberly-Clark Corporation manufactured pulp called LL-19, which is a northern softwood Kraft. The rest of the furnish was eucalyptus, which was also pulped by the Kraft process. A number 2 handsheet mold was used. The paper was dried for 3 minutes and 20 seconds.

Generally, in a commercial scale example, as shown in FIG. 5, the steps in the process of tissue formation comprise the following: the beaten pulp flows through a headbox 21 and forms into a thin web 13 by depositing the fiber on a moving wire 22, then the web 13 is dried by pressing the water out against a felt, then the dewatered sheet 15 is transferred with a smooth pressure roller 17 and creped using a doctor blade 18 and after being thermally dried on a Yankee dryer 16 and wound into rolls 19. Alternative drying methods, such as one or more throughdryers, can be used of in place of or in addition of the Yankee dryer 16. The wet-pressing removes water but densifies the sheet.

The novel new step in the drying stage to increase bulk in the test examples was to form the sheet on the handsheet mold per the standard TAPPI procedure, remove the sheet with a blotter, put the blotter with the sheet on the raised patterned felt 1 of the present invention in a standard press, press the sheet and then put the sheet and the blotter on a standard dryer to dry. Blotter paper is a thick piece of paper resembling thin cardboard that is used to pick up a sheet of paper off a surface. Basically the paper furnish adheres to the blotter paper and hence can be manipulated even though the paper in question is still being formed and is wet.

The standard TAPPI drying was modified by eliminating the bottom weight and also substituting a lighter rod in the canvas that covers the sheet during drying. The bottom weight is a weight attached to a piece of canvas that covers the sheet while it is being dried during the test procedure of the present invention. The weight serves to make certain that the canvas is held tightly on the sheet. The weight was eliminated by simply not attaching it to the canvas. A metal rod within the canvas serves a similar purpose. The metal rod was eliminated by simply removing it from the canvas. These modifications during the test procedure were merely made to not flatten the sheet and hence remove the pattern during drying. On an actual tissue machine, the pressing stage may be the only sheet-flattening operation. In this manner, weight is not added to the sheet during the drying part of the testing process because, during mass manufacturing of the sheet, the sheet has no weight on it on as it dries.

Figure 3:
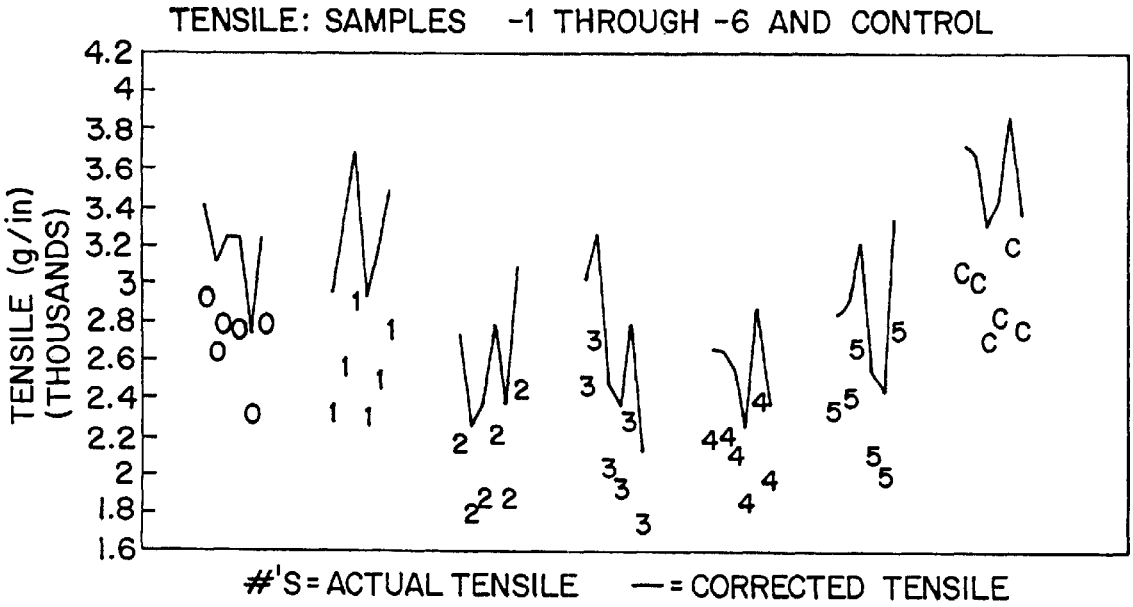
FIG. 3 is a graph of the tensile strength for the sample and control tissue sheets formed from the present invention.
Figure 4:
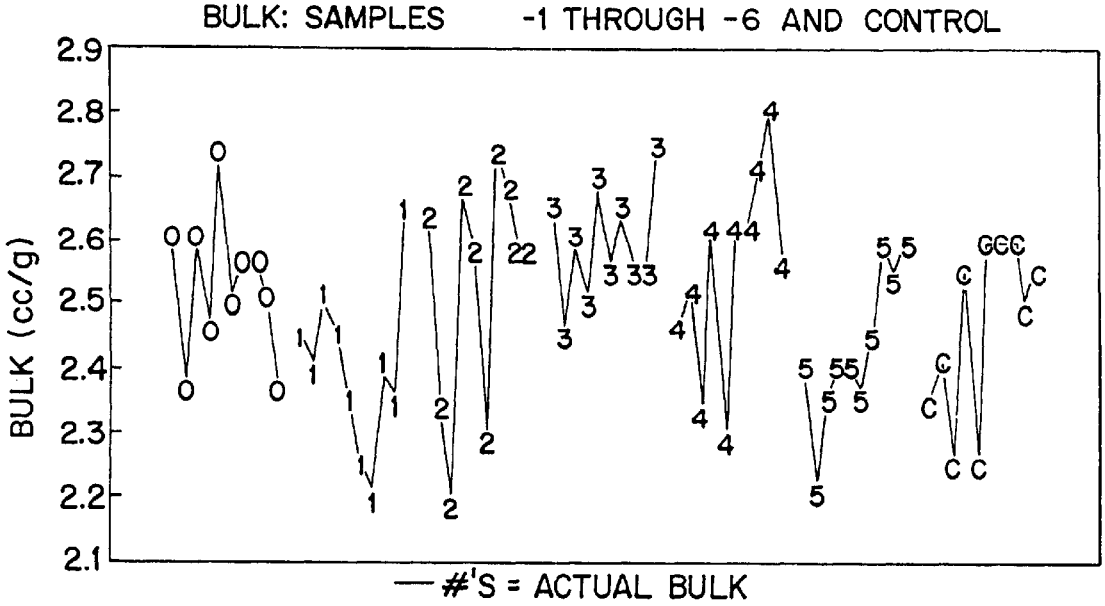
FIG. 4 is a graph of the bulk for the sample and control tissue sheets formed from the present invention.

The drying stage took approximately 3 minutes and 20 seconds to produce handsheets with increased bulk and visual aesthetics using raised pattern felts of the present invention. As shown in FIGS. 3 and 4, the following table delineates the results of the testing conducted on the handsheet formed with felts of the present invention. The paired values noted by letter identify statistically different bulk values within the pair but not with other pairs. Thus, the bulk of Sample No. 3 is statistically different than the bulk of Samples Nos. 1, 5 and the control. Sample No. 3 thus represents a preferred embodiment. The symbol $\bar{x}$ stands for mean value while S stands for standard deviation.

HANDSHEET TESTING RESULTS

| Sample No. | Basis Weight (GSM) | Bulk (CC/G) $\bar{x}$ | Bulk (CC/G) s | Tensile Strength (G/in) $\bar{x}$ | Tensile Strength (G/in) s | Statistical Difference |
|---|---|---|---|---|---|---|
| 0 | 54.57 | 2.532 | 0.112 | 2731 | 209 | |
| 1 | 50.69 | 2.405 | 0.127 | 2609 | 237 | c |
| 2 | 50.94 | 2.537 | 0.190 | 2102 | 261 | |
| 3 | 52.58 | 2.603 | 0.089 | 2230 | 358 | a,b,c |
| 4 | 53.23 | 2.562 | 0.160 | 2161 | 190 | |
| 5 | 52.75 | 2.436 | 0.120 | 2414 | 302 | b |
| Control | 52.7 | 2.472 | 0.136 | 2987 | 197 | a |

The above information on bulk and tensile strength is represented graphically in FIGS. 3 and 4.

The disclosure is provided as an exemplary only and further embodiments commensurate with the spirit of the invention are envisioned. The invention is to be limited only by the following claims.

What is claimed is:

1. A papermaking felt having a raised pattern on a surface thereof comprising:

a) a water-holding substrate having a first surface and a second surface b) a carrier layer having a raised pattern stitched there into and being joined to the first surface of the substrate;

c) an attachment mechanism joining the substrate to the carrier layer;

d) the carrier layer having a first face and an opposite second face, the second face being in contact with the first surface of the substrate; and e) the first face of the carrier layer having a plurality of projections provided by the stitching arranged in a design on said first face such that during paper formation, the design is imprinted into a resultant paper product.

2. The felt of claim 1 wherein the attachment mechanism is selected from the group consisting of needling and an adhesive.

3. The felt of claim 1 wherein the substrate comprises a woven base fabric.

4. The felt of claim 1 further including a bonding coating layer coated over the first face of the raised pattern layer.

5. The felt of claim 4 wherein the bonding coating layer comprises a porous polymeric material.

6. The felt of claim 5 wherein the porous polymeric material comprises an acrylic nitril latex coating made by a foaming process.

7. A papermaking felt having a raised pattern on a surface thereof comprising:

a) a water-holding substrate having a first surface and a second surface;

b) a carrier layer having a raised pattern stitched there into and being joined to the first surface of the substrate wherein the carrier layer comprises a non-woven hydrophobic material;

c) an attachment mechanism joining the substrate to the carrier layer;

d) the carrier layer having a first face and an opposite second face, the second face being in contact with the first surface of the substrate; and e) the first face of the carrier layer having a plurality of projections provided by the stitching arranged in a design on said first face such that during paper formation, the design is imprinted into a resultant paper product.

8. The felt of claim 7 wherein the non-woven hydrophobic material comprises spunbond nylon fibers.

* * * * *